US006158905A

United States Patent [19]

Endo

[11] Patent Number: 6,158,905

[45] Date of Patent: Dec. 12, 2000

[54] BIDIRECTIONAL PRINTER AND PRINTING POSITION ADJUSTMENT METHOD FOR THE SAME

[75] Inventor: Hironori Endo, Nagano-ken, Japan

[73] Assignee: Seiko Epson Corporation, Tokyo, Japan

[21] Appl. No.: 09/297,067

[22] PCT Filed: Aug. 31, 1998

[86] PCT No.: PCT/JP98/03908

§ 371 Date: Apr. 30, 1999

§ 102(e) Date: Apr. 30, 1999

[87] PCT Pub. No.: WO99/11465

PCT Pub. Date: Mar. 11, 1999

[30] Foreign Application Priority Data

Sep. 2, 1997 [JP] Japan ..... 9-237509
Feb. 3, 1998 [JP] Japan ..... 10-036714

[51] Int. Cl.[7] ..... B41J 11/44

[52] U.S. Cl. ..... 400/76; 400/61; 400/70; 400/279

[58] Field of Search ..... 400/279, 76, 61, 400/70

[56] References Cited

U.S. PATENT DOCUMENTS

| | | | |
|---|---|---|---|
| 4,524,364 | 6/1985 | Bain et al. | 346/1.1 |
| 4,818,129 | 4/1989 | Tanuma et al. | 400/323 |
| 5,116,150 | 5/1992 | Courtney | 400/320 |
| 5,427,461 | 6/1995 | Hirai et al. | 400/279 |
| 5,454,651 | 10/1995 | Tateyama | 400/323 |

FOREIGN PATENT DOCUMENTS

| | | |
|---|---|---|
| 2-243373 | 9/1990 | Japan . |
| 4-022665 | 1/1992 | Japan . |
| 5-69625 | 3/1993 | Japan . |
| 7-040599 | 2/1995 | Japan . |
| 7-32654 | 2/1995 | Japan . |

*Primary Examiner*—John S. Hilten
*Assistant Examiner*—Charles H. Nolan, Jr.
*Attorney, Agent, or Firm*—Oblon, Spivak, McClelland, Maier & Neustadt, P.C.

[57] ABSTRACT

An adjustment value for printing deviation between forward and reverse printing passes is set for each width of printing paper. The printing deviation is adjusted by, for example, varying, in the main scanning direction, the frequency of the drive clock signal applied to the print head. The drive clock signal frequency is individually set for each of a plurality of regions into which the main scanning range is divided.

20 Claims, 10 Drawing Sheets

DEVIATION AMOUNT ΔX
ΔX
+
0
−
0 L1 L2 L3 L4 Lmax X

IDEAL CORRECTION AMOUNT δ
δ
+
0
−
0 L1 L2 L3 L4 Lmax X

DRIVE CLOCK FREQUENCY $f_{CLK}$
$f_{CLK}$(KHz)
f3
f2
f1
0 L1 L2 L3 L4 Lmax X
R1 R2 R3 R4 R5

FORWARD
X
ΔX
(FORWARD)
(REVERSE)
REVERSE
-X

FORWARD
X
REVERSE
-X

BIDIRECTIONAL PRINTER AND PRINTING POSITION ADJUSTMENT METHOD FOR THE SAME

FIELD OF THE INVENTION

The present invention relates to a technology for printing images on printing media using a bidirectional reciprocating movement in the main scanning direction. More particularly, it relates to a technology for adjusting printing positional deviation in the main scanning direction between forward and reverse passes.

DISCUSSION OF THE BACKGROUND

In recent years color printers that emit colored inks from a print head are coming into widespread use as computer output devices. Among such printers, there are those that are equipped with the ability to print bidirectionally in order to improve printing speed.

A problem that readily arises in bidirectional printing is that of deviation in printing position in the main scanning direction between forward and reverse printing passes. Causes of this deviation include backlash in the main scanning drive mechanism, stretching of the carriage belt, and warping of the platen on which the printing medium rests. Japanese Patent Laid-open Hei 5-69625 is an example of a technology disclosed by the present applicants for solving this problem of printing deviation. This comprises of registering beforehand the printing deviation amount in the main scanning direction and using this printing deviation amount as a basis for correcting the printing position on the forward and reverse passes.

However, various printing media are used including A3 size paper, A4 size paper and postcards. For printing, A3 and A4 sheets are generally inserted into approximately the center of the main scanning stroke range of the printer, while postcards are inserted at one end. Printing deviation tends to be particularly large at each end of a printer's main scanning stroke. Thus, while printing deviation may be properly adjusted for an A4 or A3 sheet, it is difficult to properly adjust for printing deviation in the case of postcards.

An object of the present invention is to provide a new technology for reducing printing position deviation in the main scanning direction between forward and reverse passes in a printer that prints bidirectionally.

DISCLOSURE OF THE INVENTION

In order to solve at least part of the above and other problems, there is provided a printer that is able to bidirectionally print images on a printing medium during reciprocal main scanning in each direction. The printer comprises: a print head; a drive mechanism that effects relative movement between at least the print head and the printing medium in a main scanning direction and a sub-scanning direction and drives the print head to print on the printing medium; and a controller that controls the drive mechanism. The controller includes a printing deviation adjuster for adjusting a printing position in accordance with print head position in the main scanning direction on at least one of a forward pass and a reverse pass so that a printing position in the main scanning direction on the forward pass and a printing position in the main scanning direction on the reverse pass are made to substantially coincide.

The printing deviation adjuster may adjust the printing position in accordance with an actual main scanning range of the print head and the position of the print head in the main scanning direction.

The controller may further include an adjustment value memory for storing adjustment values used to adjust the printing position with respect to each of a plurality of printing media having different widths in the main scanning direction; wherein the printing deviation adjuster may read out an adjustment value from the adjustment value memory according to the width of the printing medium in the main scanning direction that is actually used for printing, and performs the adjustment of the printing position in accordance with the adjustment value thus read out.

The printer may further comprise a memory for storing data for printing a plurality of printing deviation check patterns for the plurality of printing media.

The printing deviation adjuster may use an offset to correct the printing deviation adjustment value, the offset being based on a thickness of the printing media actually used for printing.

The printing deviation adjuster may adjust the printing position at a center position in the main scanning direction of each of the plurality of printing media.

Moreover, the printing deviation adjuster may adjust the printing position at each of a plurality of points in the main scanning direction of each of the plurality of printing media.

The above printer can properly adjust the printing deviation for a plurality of printing media.

In a preferred embodiment, the printing deviation adjuster includes a drive clock generator that generates a drive clock signal that is applied to the print head and adjusts a frequency of the drive clock signal along the main scanning direction during at least one of the forward pass and the reverse pass.

The drive clock generator may individually set the drive clock signal frequency for each of a plurality of regions into which the main scanning range is divided.

The drive clock generator may include: an adjustment memory for storing parameters used to set the drive clock signal frequency for each of the plurality of regions; a reference clock generator that generates a reference clock signal having a prescribed base frequency; a frequency converter that, using the parameters read out of the adjustment value memory, generates the drive dock signal by converting the frequency of the reference clock signal; and a parameter setting unit that determines in which of the plurality of regions the main scanning position of the print head is located, reads out from the adjustment value memory the parameters for the region in which the main scanning position is located and sets the parameters in the frequency conversion unit.

The parameter setting unit may change a section of the plurality of regions and the parameter values in accordance with the width and thickness in the main scanning direction of the printing media that is used.

The above printer can reduce the printing position deviation in the main scanning direction between the forward and reverse passes by changing the frequency of the drive clock signal along the main scanning direction during at least one of the forward pass and the reverse pass.

The present invention is further directed to a method of adjusting printing position in a main scanning direction for a printer that is able to bidirectionally print images on a printing medium with a print head during reciprocal main scanning in each direction. In this method, a printing position is adjusted in accordance with print head position in the main scanning direction on at least one of a forward pass and a reverse pass so that a printing position in the main scanning direction on the forward pass and a printing position in the main scanning direction on the reverse pass are made to substantially coincide.

DETAILED DESCRIPTION OF THE PREFERRED EMBODIMENTS

A. Correction of printing deviation according to the printing paper

Figure 1:
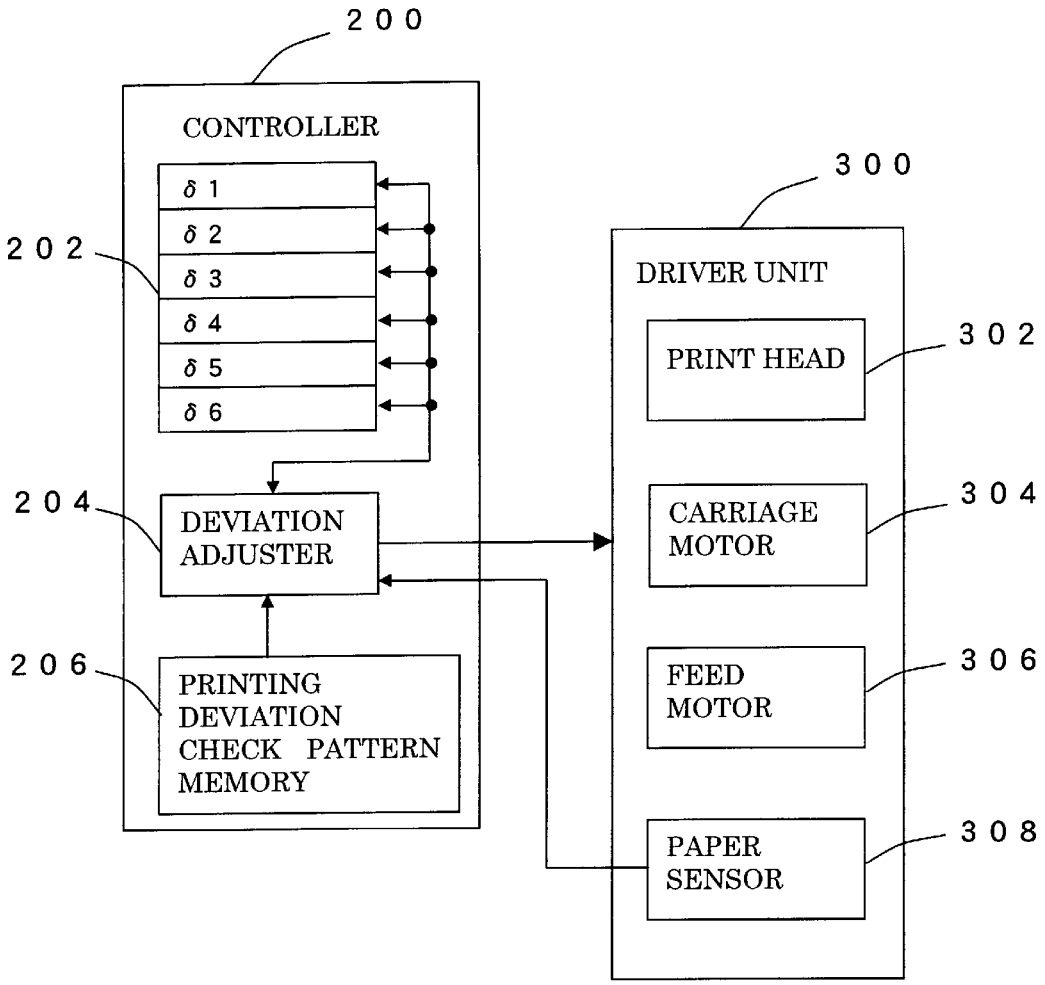
FIG. 1 is a conceptual diagram of the present invention applied to an inkjet printer.

FIG. 1 is a conceptual drawing of the present invention applied to an ink-jet printer. The ink-jet printer includes a controller 200 and a driver unit 300. The controller 200 includes a deviation adjustment value memory 202, a deviation adjuster 204 and a deviation check pattern memory 206. The driver unit 300 includes a print head 302, a carriage motor 304, a feed motor 306 and a paper sensor 308.

Parameters for printing a printing deviation check pattern are stored in the deviation check pattern memory 206. To a certain extent, the types of paper that can normally be used by a printer are limited. The deviation adjustment value memory 202 holds printing deviation adjustment values δ1, δ2, δ3 . . . relating to the printing paper used, as determined using check patterns for each type of paper.

The paper sensor 308 detects the type of paper (the paper width) actually used for printing. The paper sensor 308 detects the type of printing paper actually used from among a plurality of types of printing paper registered beforehand. The deviation adjuster 204 adjusts the printing deviation by controlling the driver unit 300, using adjustment value δi (where i denotes the ith printing sheet).

As described below, printing deviation can be adjusted by adjusting the frequency of the drive clock generator supplied to the print head 302, or by any other arbitrary method.

Figure 2A:
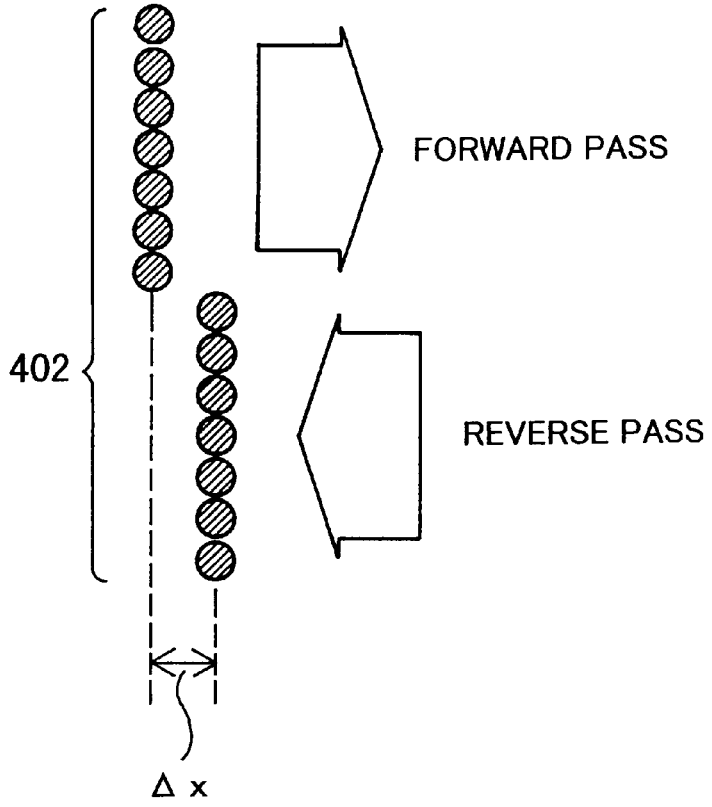
FIGS. 2(*a*) and 2(*b*) show an example of printing deviation adjustment.
Figure 2B:
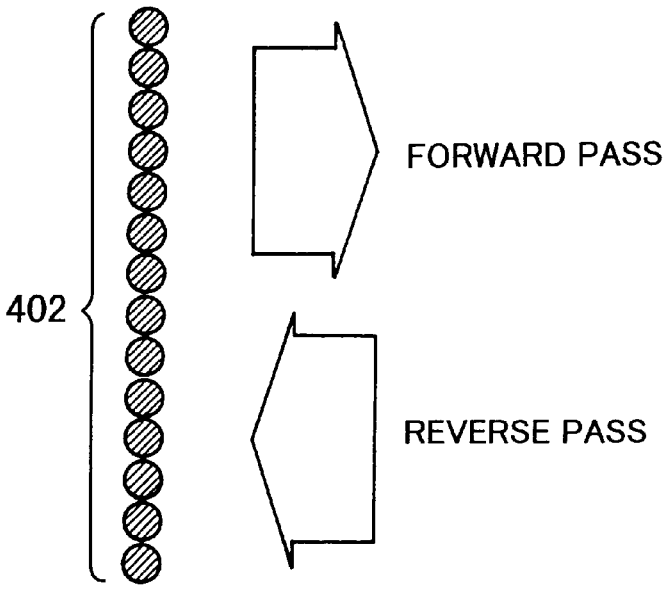

FIGS. 2(*a*) and 2(*b*) illustrate adjustment of printing deviation using a deviation check pattern. As shown in FIG. 2(*a*), check pattern 402 is formed by printing a row of dots in the sub-scanning direction during the forward pass and also printing a row of dots in the sub-scanning direction during the reverse pass. The deviation amount Δx in the main scanning direction between the row of dots printed on the forward pass and the row of dots printed on the reverse pass is detected as bidirectional printing deviation. The printing deviation Δx can be detected visually or it can be detected automatically by using an optical position detection device, not shown. In FIG. 2(*b*), the printing deviation amount Δx of FIG. 2(*a*) has been adjusted to zero. The printing deviation adjustment amount δ (here, δ=Δx) can be input by the person making the adjustment or the adjustment amount can be automatically determined from the result of detection by an optical position detection device, for example.

Figure 3:
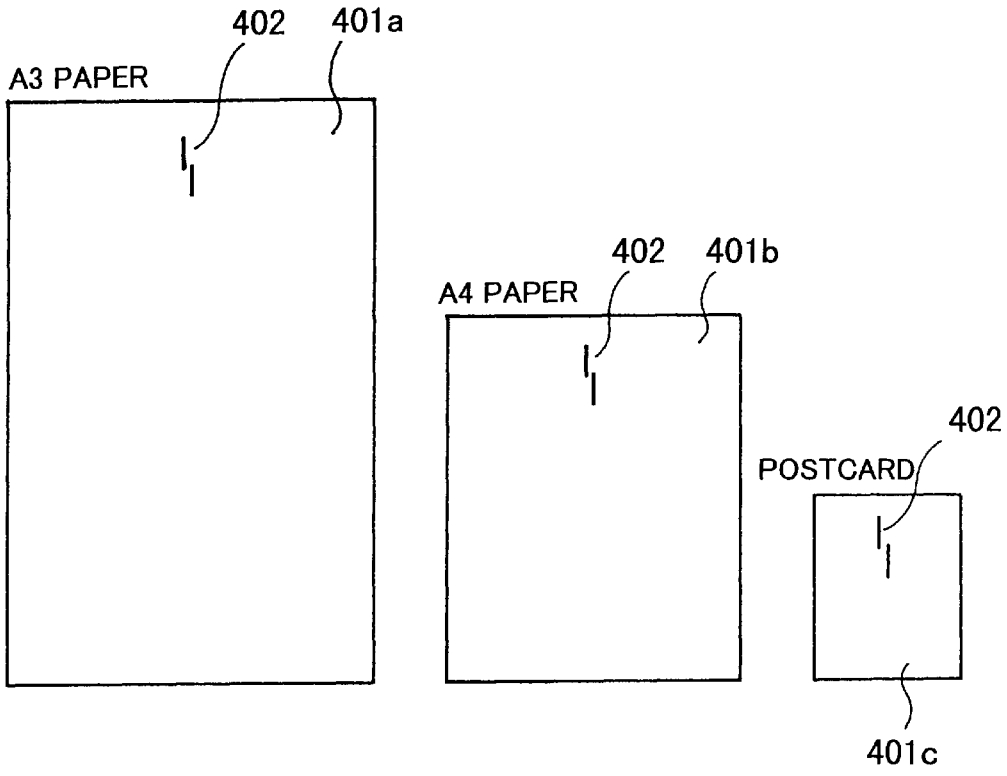
FIG. 3 shows an example of a printing deviation check pattern.

FIG. 3 shows examples of printing deviation check patterns for the various types of printing paper. Here, specifically, a check pattern 402 has been printed approximately in the center, in the main scanning direction, of an A3 sheet 401*a*, an A4 sheet 401*b* and a postcard 401*c*. In each case printing deviation adjustment is carried out to reduce the deviation check pattern 402 to zero at the center of the main scanning stroke.

As an example, a determination of the printing deviation adjustment amount δi of an ink-jet printer in which A3 is the maximum sheet size that can be printed is carried out as follows. First, in order to print the deviation check pattern on an A3 sheet, an A4 sheet and a postcard, the check pattern data for each of these sheets are prepared and stored in the deviation check pattern memory 206. These same check pattern data are used by all printers of the same type. Then, as shown in FIG. 3, the appropriate check pattern is printed on each sheet and the printing deviation amount Δx of the pattern 402 is measured. Next, the bidirectional printing deviation adjustment values δ1, δ2, δ3 . . . are determined that will reduce the deviation amount Δx to zero, and these adjustment values δ1, δ2, δ3 . . . are stored in deviation adjustment value memory 202. Since the printing deviation amount Δx may vary from individual printer to printer, even when the printers are of the same type, adjustment values δ1, δ2, δ3 . . . are also set for each individual printer. As such, as the deviation adjustment value memory 202, it is preferable to use a rewritable, non-volatile memory into which the adjustment values δ1, δ2, δ3 . . . for each individual printer can be written.

Figure 4:
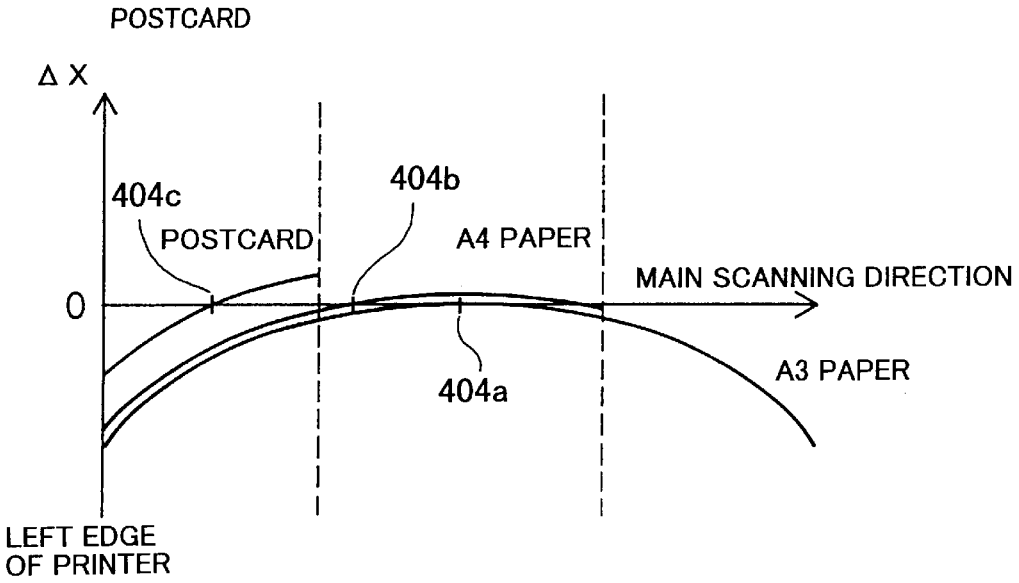
FIG. 4 is a graph showing the results of adjustment of printing deviation in the main scanning direction of an ink-jet printer.

FIG. 4 is a graph showing the distribution of printing deviation amount Δx with respect to a plurality of printing sheets having different widths. Here, it is assumed that each printing sheet fed into the printer is aligned with the left side of the paper tray (not shown). The deviation adjustment value required to reduce to zero the deviation amount Δx at the respective main scanning stroke center positions 404*a*, 404*b* and 404*c* of the sheets is determined. That is, in the example of FIG. 4, an appropriate adjustment amount is set for each sheet, the result of which is to minimize degradation of printing quality caused by printing deviation. The printing deviation amount is larger at each end of the printable range in the main scanning direction (at the limits of print head movement). This means that if the printer is adjusted for printing deviation in the case of an A3 sheet, which is the largest width that the printer can handle, it may not be adjusted for deviation in the case of the small width of a postcard. Using the individual adjustment values for each printing sheet, as shown in FIG. 4, allows appropriate adjustment of printing deviation to be achieved even with respect to narrow sheets such as postcards. Moreover, since the adjustment values for each type of printing sheet are stored in the adjustment value memory 202, an adjustment that has been carried out for a printing sheet does not have to be repeated.

Even if printing sheets are the same size, the width in the main scanning direction can differ depending on the orientation of the sheet (that is, portrait orientation or landscape orientation). For example, an A3 sheet in the portrait orientation has the same width in the main scanning direction as an A4 sheet in the landscape orientation. This being the case, it is preferable to adjust for printing deviation based not on the size of the printing sheet but in accordance with what the width is in the main scanning direction when the sheet is fed into the printer.

Figure 5:
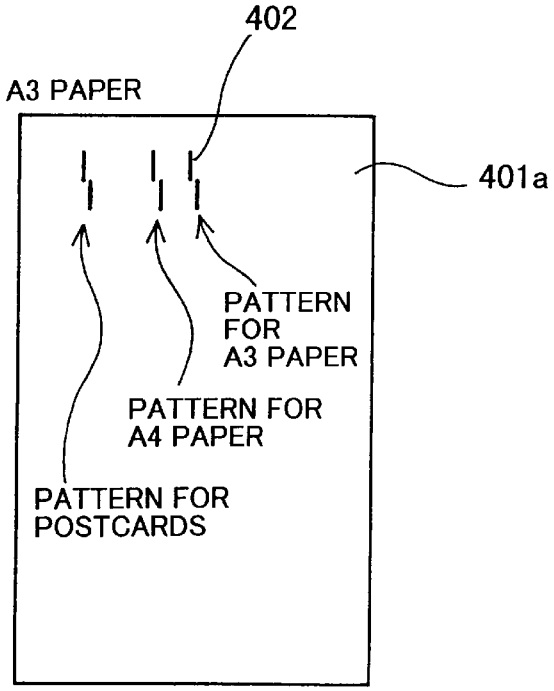
FIG. 5 is an example of another printing deviation check pattern.

FIG. 5 shows an example of another printing deviation check pattern. In this example, instead of printing the check pattern on a plurality of printing sheets having different widths, all of the check patterns for the various paper sheets are printed on a sheet of the widest paper, A3 sheet 401*a*.

More specifically, when A3 is the largest paper size that can be printed by the printer, data for printing deviation check patterns for A3, A4 and postcard size sheets on one sheet are prepared and stored beforehand in the deviation check pattern memory 206. These check patterns are then printed on a single sheet (A3, in this case) and used to determine the adjustment values δ1, δ2, δ3 . . . for bidirectional printing deviation with respect to all sheet widths. The adjustment values δ1, δ2, δ3 . . . for each sheet are then stored in the deviation adjustment value memory 202.

Since the method of FIG. 5 does not use the plurality of printing sheets to adjust the printing deviation, when the thickness of the sheet which is used in the printing deviation adjustment is different from that of an actually used sheet, the different thickness may give rise to some printing deviation. Thus, when using printing paper that has quite a different thickness from the thickness of the paper used to print the check pattern, it is preferable to automatically correct the adjustment value by applying an offset to the deviation adjustment amount corresponding to the thickness of the sheet. For example, the thickness of a postcard can be measured beforehand to set an offset for the difference in deviation amount resulting from the postcard thickness differential, and the offset then added to the printing deviation adjustment value. The printing deviation adjustment amount offsets may be stored in the deviation adjustment value memory 202 separately from the adjustment values δ1, δ2, δ3 . . . determined by the method of FIG. 5, or adjustment values δ1, δ2, δ3 . . . that reflect the offset may be stored in the adjustment value memory 202. The offset may be changed by using paper sensor 308 to automatically detect the thickness of the paper actually being used in the printer, and the proper offset being selected based on the detection result. In this case, storing the offset values separately from the adjustment values δ1, δ2, δ3 . . . allows the printing deviation adjustment amount to be corrected by an offset appropriate for the thickness, even with respect to printing sheets that are of the same width.

Printing the check patterns for all printing sheets on a single sheet, as in FIG. 5, allows printing deviation adjustment to be carried out using plain, cheap paper, eliminating the need to use coated paper or postcards for deviation adjustment purposes.

Figure 6:
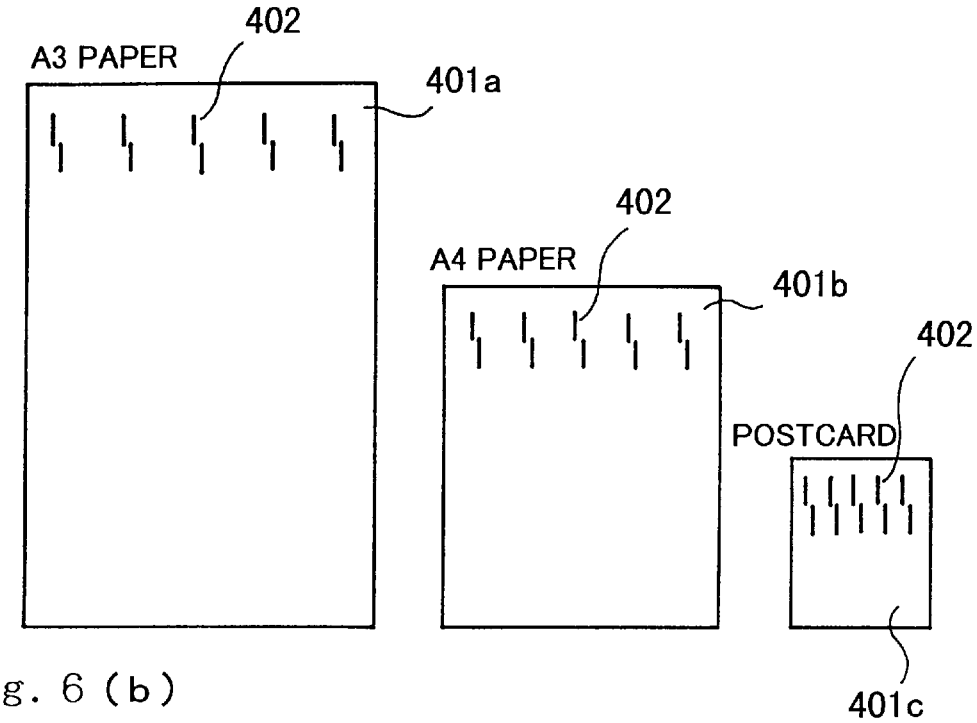
FIGS. 6(*a*) and 6(*b*) are examples of other printing deviation check patterns.
Figure 6:
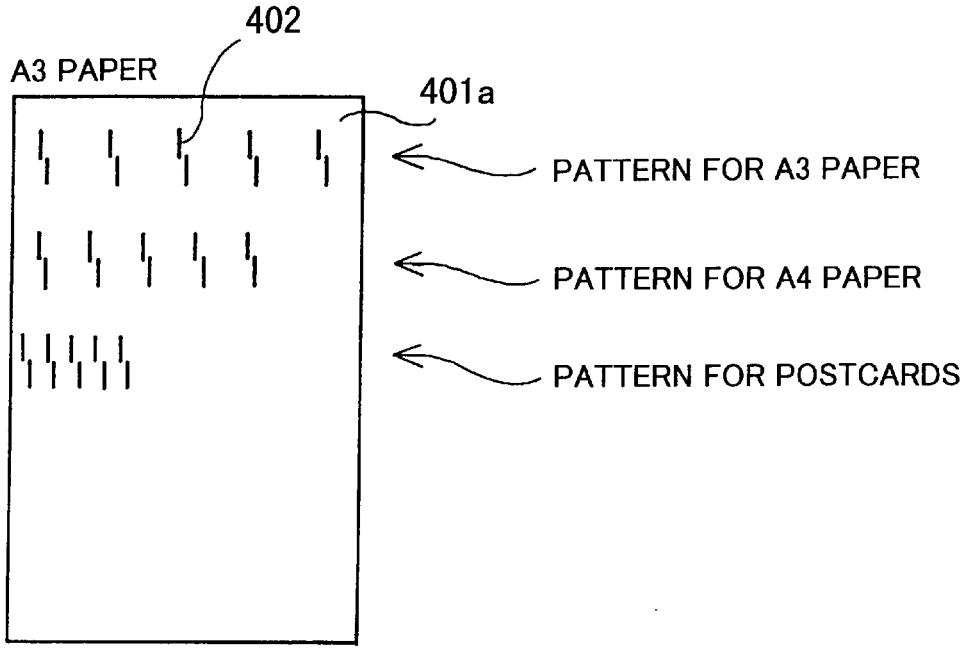

It is also possible to print a check pattern at a plurality of locations on the paper in the main scanning direction and adjust printing deviation at each of those points. As shown in FIGS. 6(*a*) and 6(*b*), for example, the type of check pattern shown in FIG. 2 may be printed at five points in the main scanning direction on sheets of different widths, and the average deviation value at the five locations may be used as the deviation adjustment value. Alternatively, as described later, a different adjustment amount may be set for each of the five locations to adjust the printing position at each location.

Changes in temperature and other such changes in environmental conditions may also give rise to differences in bidirectional printing deviation amounts. Such changes in environmental conditions can be readily handled by using a single printing sheet to again adjust the printing deviation to determine a readjustment value and then adding the difference between the previous adjustment value and the readjustment value to the adjustment values for all the other sheet widths and thicknesses. However it is handled, it is not necessary to redetermine the adjustment values using all of the printing sheets.

These embodiment has been described with reference to the example of a printer in which the sheets of printing paper are aligned with the left side of the paper tray, as shown in FIG. 4. In this case, paper having a different width will have a different center position. The center position of an A3 sheet, for example, will be approximately in the center of the scanning travel stroke of the print head, while the center of a postcard would be in the left part of the print head stroke (FIG. 4). Therefore, instead of changing the printing deviation adjustment value according to the main scanning width of each sheet, the adjustment value can be changed in terms of a position along the scannable range of the print head that corresponds to the center position of the sheet. As described in the foregoing, an adjustment value for printing deviation occurring between forward and reverse printing passes is set for each of the different sheet scanning widths, which, by enabling the proper adjustment for each sheet to be effected, allows high-speed bidirectional printing to be achieved with degradation of print quality caused by roughness and backlash held to a minimum. In addition, once adjustment has been carried out for a printing paper, no readjustment is required for that paper. Particularly in the case of bidirectional printing of postcards, for which home-use ink-jet printers are very frequently used, printing deviation can be kept to a minimum.

B. Printer configuration

Figure 7:
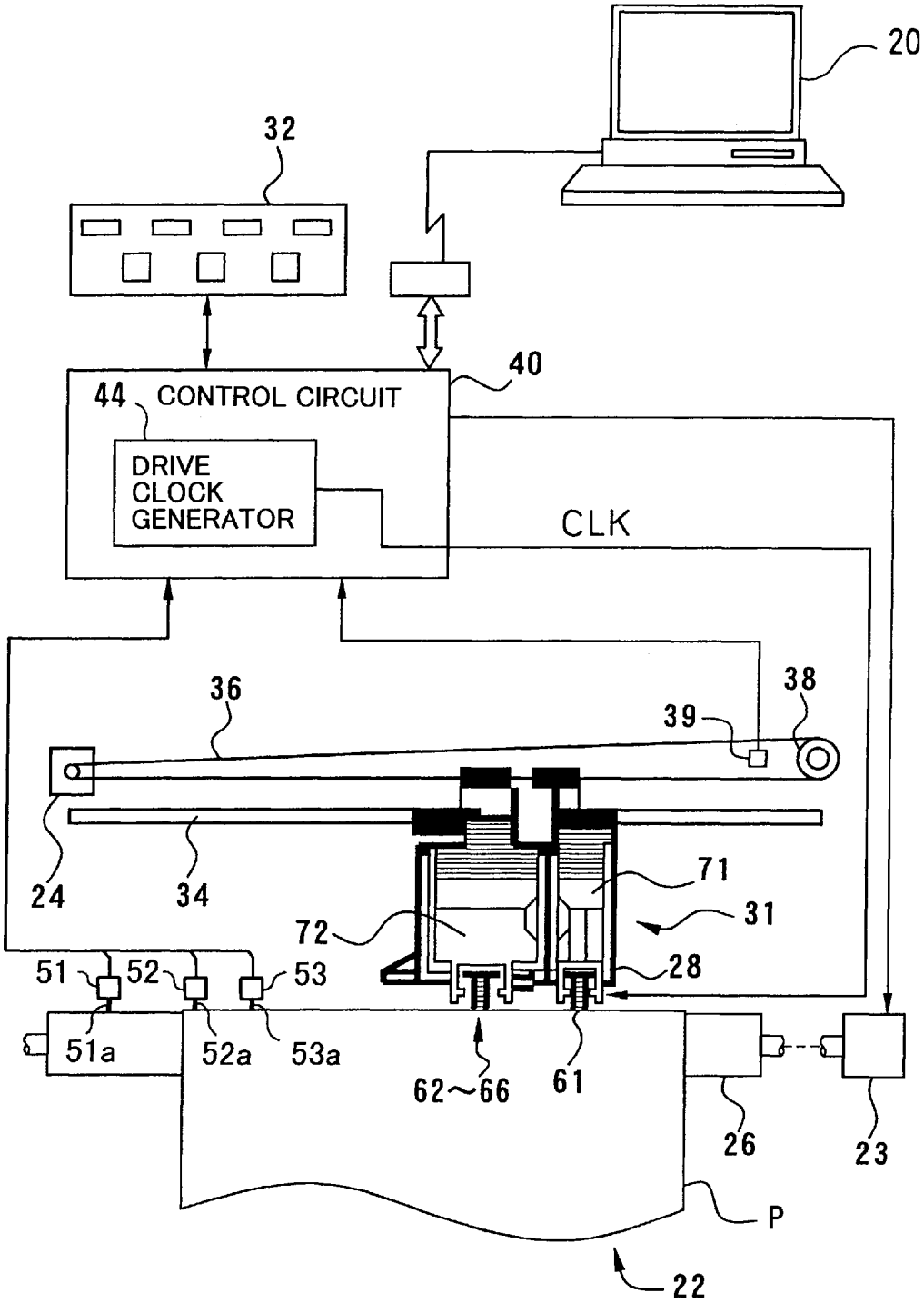
FIG. 7 illustrates the configuration of a printer that is an embodiment of the present invention.

FIG. 7 illustrates the configuration of a computer system equipped with a printer that is an embodiment of the present invention. The computer system includes a computer 20 and a printer 22. The printer 22 prints images on paper P based on image signals sent from the computer 20.

The printer 22 includes a sub-scanning drive mechanism that uses a paper feed motor 23 to transport the paper P, a main scanning drive mechanism that uses a carriage motor 24 to effect reciprocating movement of a carriage 31 in the axial direction of a platen 26, a printing mechanism that drives a print head 28 mounted on the carriage 31 and controls ink emission and dot formation, and a control circuit 40 that controls communication of signals between the feed motor 23, the carriage motor 24 the print head 28 and control panel 32.

A black-ink cartridge 71 and a colored-ink cartridge 72 containing inks of the five colors cyan, light cyan, magenta, light magenta and yellow can be mounted on the carriage 31. The print head 28 at the lower part of the carriage 31 has six ink-jet heads 61–66.

The feed motor 23 effects sub-scanning by using the rotation of the platen 26 and rollers to transport the paper P. The carriage motor 24 effects bidirectional main scanning by reciprocating the carriage 31. During main scanning the control circuit 40 drives piezoelectric elements (described later) of the ink-jet heads 61–66 of the print head 28 to emit the variously colored inks to thereby form multicolored images on the printing paper P. The paper P is transported by the rotation of the platen 26 by the feed motor 23, and by a gear-train (not shown) linked to the feed rollers. The mechanism for effecting reciprocating movement of the carriage 31 includes a slide-shaft 34 that slidably supports the carriage 31, mounted in parallel with the shaft of the platen 26, a pulley 38 connected to the carriage motor 24 by an endless drive belt 36, and a position sensor 39 for detecting the starting (or home) position of the carriage 31.

The control circuit 40 includes a drive clock generator 44 that generates a drive clock signal CLK that prescribes the ink-jet emission timing of the print head 28. The drive clock generator 44 is able to change the position at which ink is emitted (that is, the position at which a dot is placed on the paper) in the main scanning direction by adjusting the frequency of the drive clock signal CLK. The internal configuration will be described later.

The paper path in the printer 22 is provided with paper sensors 51–53, which are provided with paper sensing pins 51*a*–51*c*, respectively. The control circuit 40 detects the main scanning width of paper fed into the printer based on the paper sensing pin or combination of paper sensing pins that are pushed by the paper (pins 52*a* and 53*a* in the example shown in FIG. 7). The thickness of the paper can also be detected based on the amount by which the pins 52*a* and 53*a* are pushed in by the paper. Instead of using the paper sensors 51–53, the width and thickness of the paper can be detected from the paper size and orientation (portrait or landscape) set by a user, using a printer driver (not shown) of the computer 20.

The paper sensors 51–53 of FIG. 7 correspond to the paper sensor 308 of FIG. 1, and the print head 28, carriage motor 24 and feed motor 23 of FIG. 7 correspond to the print head 302, carriage motor 304 and feed motor 306 of FIG. 1. The control circuit 40 of FIG. 7 corresponds to the controller 200 of FIG. 1.

Figure 8:
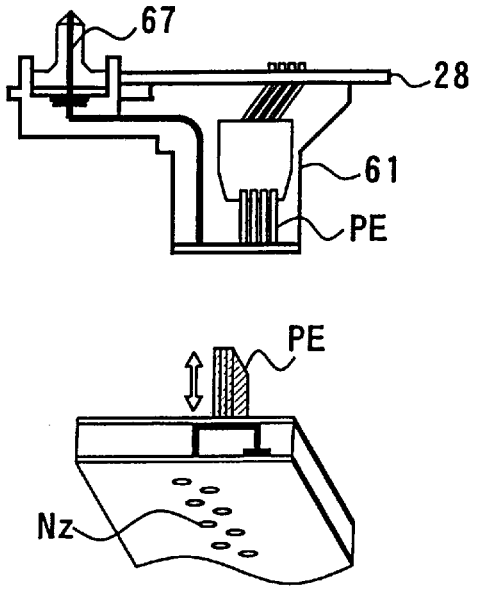
FIG. 8 illustrates a configuration of a dot printing head in a printer according to the present invention.

FIG. 8 shows the internal structure of the ink-jet print head 28. When ink cartridges 71 and 72 are mounted on the carriage 31, as shown in FIG. 8, capillary action is used to draw the ink out through inlet tube 67 to the ink heads 61–66 of the print head 28 provided on the lower part of the carriage 31. When an ink cartridge is first inserted, a special pump is used to suck the ink to the heads 61–66. Here, however, configuration illustration and explanation of the pump used for this and of the cap used to cover the print head 28 during the suction process are omitted.

Figure 9:
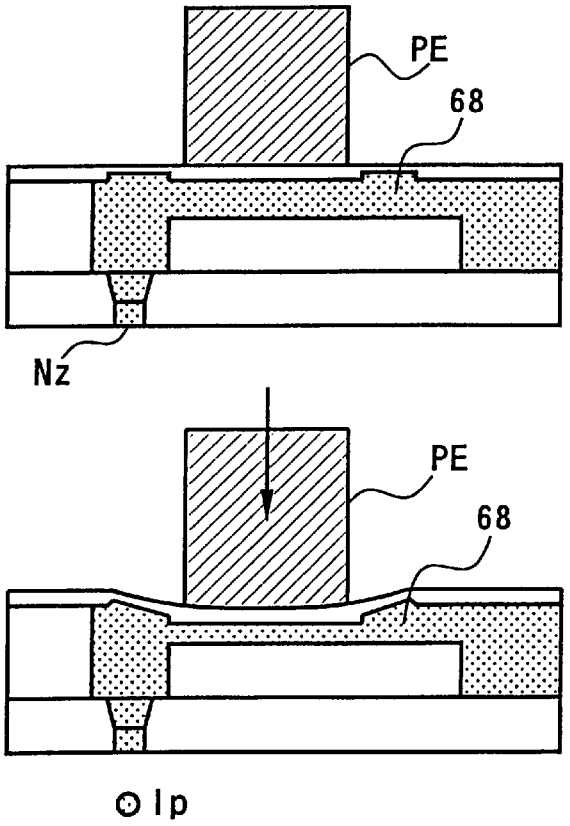
FIG. 9 illustrates the dot formation mechanism in a printer according to the present invention.

Ink heads 61–66 are each provided with a plurality of nozzles Nz for each ink color; for each nozzle there is a piezoelectric element PE having good response characteristics. FIG. 9 is a detailed drawing of the structure of a piezoelectric element PE and nozzle Nz. As shown, the piezoelectric element PE is located adjacent to an ink channel 68 via which ink is taken to a nozzle Nz. As known, applying an electrical charge to a piezoelectric element produces a distortion of the crystalline structure, and this can be used to achieve very high-speed conversion of electrical to mechanical energy. In the case of this embodiment, when a voltage of prescribed duration is applied across the electrodes of the piezoelectric element PE, the piezoelectric element PE expands lengthwise for the duration of the voltage application. This deforms a wall of the ink channel 68, reducing the volume of the ink channel 68 by an amount corresponding to the expansion of the piezoelectric element PE, thereby expelling a corresponding amount of ink in the form of a particle Ip that is emitted at high speed from the nozzle Nz. Printing is effected by such ink particles Ip impinging onto the paper P on the platen 26.

C. Method of correcting printing deviation during bidirectional printing

Figures 10A, 10B, 10C, 10D, 10E:
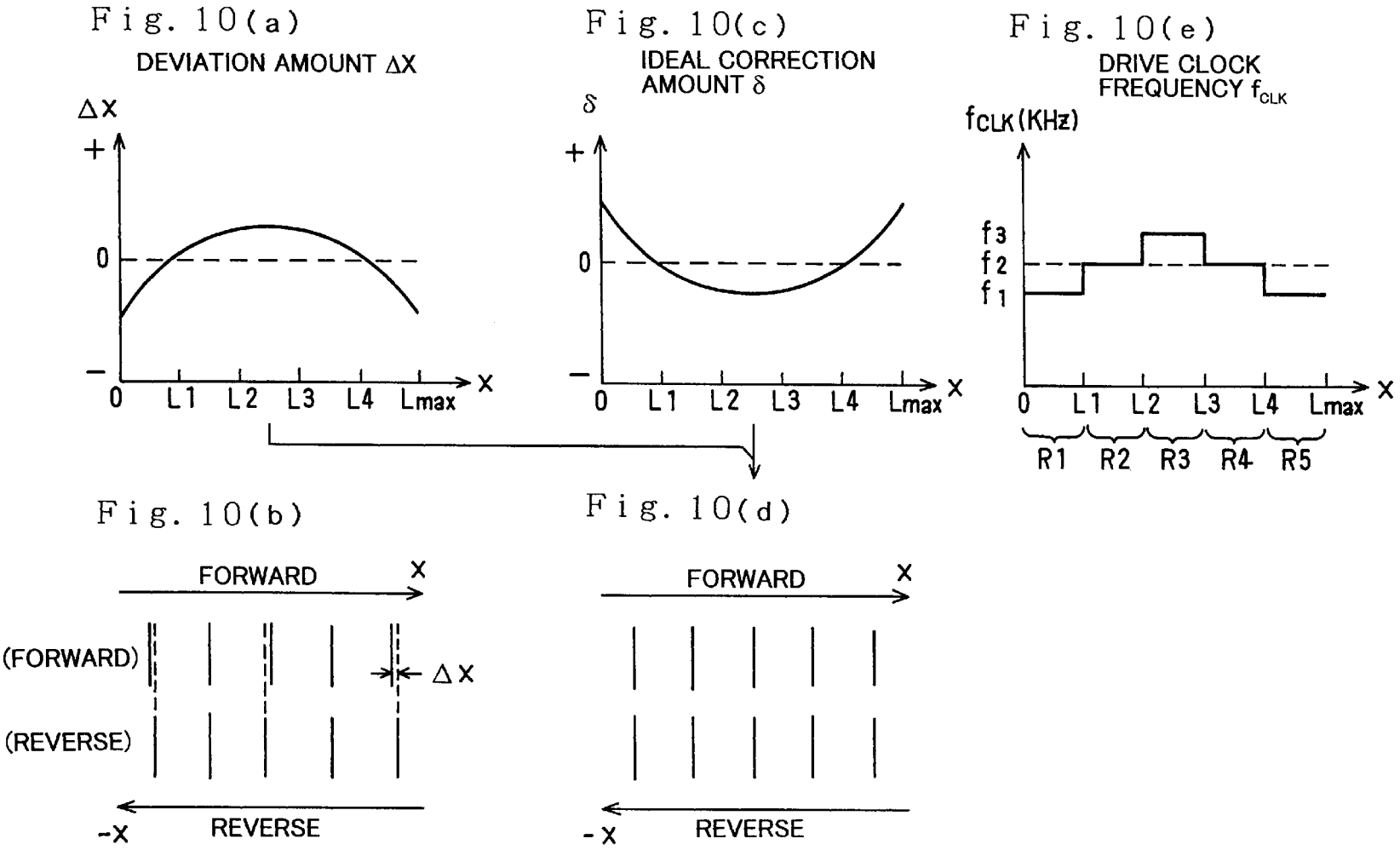
FIGS. 10(*a*)–10(*e*) illustrate methods of correcting bidirectional printing deviation in an embodiment of the present invention.

FIG. 10 illustrates the method of correcting printing deviation during bidirectional printing. FIG. 10(*a*) shows the distribution of the printing deviation amount Δx in the main scanning direction when correction is not applied. FIG. 10(*b*) shows the corresponding deviation in printing position (pixel position) between forward and reverse printing passes. In FIG. 10(*a*) the horizontal axis x is the main scanning direction, corresponding to the direction of lines on the printing paper. Hereinbelow, the width Lmax of the printing paper in the main scanning direction is referred to as "main scanning width" or "main scanning range." As indicated by the solid line in FIG. 10(*b*), printing deviation amount Δx between printing positions of forward and reverse passes arising from platen warpage and stretching of the carriage belt and the like, changes along the main scanning direction. The horizontal axis x of FIG. 10(*b*) is defined as a coordinate axis of the forward pass in the main scanning direction, while deviation amount Δx is defined by deducting the reverse printing position from the forward printing position. In the example of FIG. 10(*a*), the distribution of deviation amount Δx in the main scanning direction forms an upward curve, having a positive value in substantially the center of the main scanning width Lmax and a negative value at each end. The zero level of the deviation amount Δx is arbitrary; in the case of FIG. 10(*a*) the average of the deviation amount Δx across the main scanning width Lmax is used as the zero level. Also, depending on the printer, the distribution of the deviation amount Δx may form a downward-oriented curve, in contrast to that of FIG. 10(*a*). Since deviation amount Δx differs from individual printer to printer, the actual deviation amount Δx on the paper is measured for each printer.

FIG. 10(*c*) shows the distribution of an ideal correction amount δ for correcting the deviation of FIG. 10(*a*). FIG. 10(*d*) shows that, after correction, the deviation amount Δx is reduced almost to zero. The ideal correction amount δ reverses the positive-negative distribution of the deviation amount Δx of FIG. 10(*a*).

FIG. 10(*e*) shows different frequencies $f_{CLK}$ of drive clock signal CLK (FIG. 7) used to correct printing deviation in this embodiment. For this, the main scanning width Lmax is divided into five substantially equal regions R1–R5 and the frequency $f_{CLK}$ of the drive clock signal CLK is set individually for each region. L1 to L4 are the boundaries between regions. At the regions R2 and R4 in which the correction amount δ of FIG. 10(*c*) is close to zero, the frequency $f_{CLK}$ is set at a standard value $f_2$; for region R3 in which the correction amount δ is negative the frequency $f_{CLK}$ is set at a value $f_3$ that is larger than the standard value $f_2$; and for regions R1 and R5 in which the correction amount δ is positive the frequency $f_{CLK}$ is set at a value $f_1$ that is smaller than the standard value $f_2$. The ink-jet emission timing of the print head 28 depends on the frequency of the drive clock signal CLK. Accordingly, as the frequency $f_{CLK}$ increases, the ink emission cycle becomes shorter, shrinking the distance between adjacent dots in the main scanning direction. The relationship between the frequency $f_{CLK}$ dependency of the dot placement position and printing deviation correction will be described later.

Individually setting the frequency $f_{CLK}$ of the drive clock signal CLK for each of the plurality of regions into which the main scanning range is divided, as shown in FIG. 10(*e*), makes it possible to realize a correction amount δ that is close to ideal. Also, if the capabilities of the drive clock generator 44 permits, the adjustment of the frequency of the drive clock signal CLK can be implemented on a substantially continuous basis. However, a circuit configuration that adjusts the drive clock signal CLK frequency in steps, as in FIG. 10(*e*), does have the advantage of simplicity.

The deviation amount Δx can be reduced more or less to zero by applying the FIG. 10(*e*) type of frequency changes on the reverse pass and, on the forward pass, maintaining the frequency $f_{CLK}$ at a set value (the standard value $f_2$, for example). Or, frequency $f_{CLK}$ can be adjusted during the forward pass and a fixed frequency $f_{CLK}$ maintained during the reverse pass. That is, it is only necessary to ensure that the frequency $f_{CLK}$ of the drive clock signal CLK is adjusted during either the forward pass or the reverse pass.

The main scanning drive signal used to drive the carriage motor 24 is maintained at the same fixed frequency during both the forward and reverse passes. Thus, changing the frequency $f_{CLK}$ of the print head 28 drive clock signal CLK, as in FIG. 10(*e*), results in a corresponding change in the printing position in the main scanning direction (the position at which ink is emitted). Changing the frequency of the main scanning drive signal does not prevent bidirectional printing position deviation from being corrected.

The relationship between the frequency $f_{CLK}$ dependency of the dot placement position and printing deviation correction will now be described. As mentioned, the higher the frequency $f_{CLK}$, the closer together the dots are placed. In the case of the regions R1 and R5 of FIG. 10(*e*) the frequency $f_{CLK}$ is relatively low, so the distance between adjacent dots is relatively large, so that compared to FIG. 10(*b*), the printing position on the reverse pass will have more of a deviation in the minus x direction. In contrast, in the case of region R3 the frequency $f_{CLK}$ is relatively high, so the distance between adjacent dots is relatively small, so that compared to FIG. 10(*b*), the printing position on the reverse pass will have more of a deviation in the plus x direction. Thus, the printing position on the reverse pass is corrected so that the printing positions on the forward and reverse passes substantially coincide, as in FIG. 10(*d*). Moreover, when the frequency $f_{CLK}$ is to be adjusted on the forward pass, the frequency $f_{CLK}$ should be adjusted using the same type of distribution as that of FIG. 8(*e*). The distribution of the deviation amount Δx can be measured by various methods. For example, when the printer is being assembled the forward pass and the reverse pass can each be used to print the same pattern (such as a pattern of black and white stripes, for example). Then, the result of this printing can be used to manually measure deviation amount Δx in each of the regions R1 to R5. Or, the printer 22 can be provided with an optical reading device such as a CCD camera to automatically measure the deviation amount Δx while the same pattern is being printed by both forward and reverse passes. The measured deviation amount Δx (or the corresponding correction amount δ, frequencies $f_1$–$f_3$, or the frequency division ratio n, m described below) for each of the regions R1–R5 is registered in the control circuit 40 (FIG. 7).

D. Internal configuration of the drive clock generator 44

Figure 11:
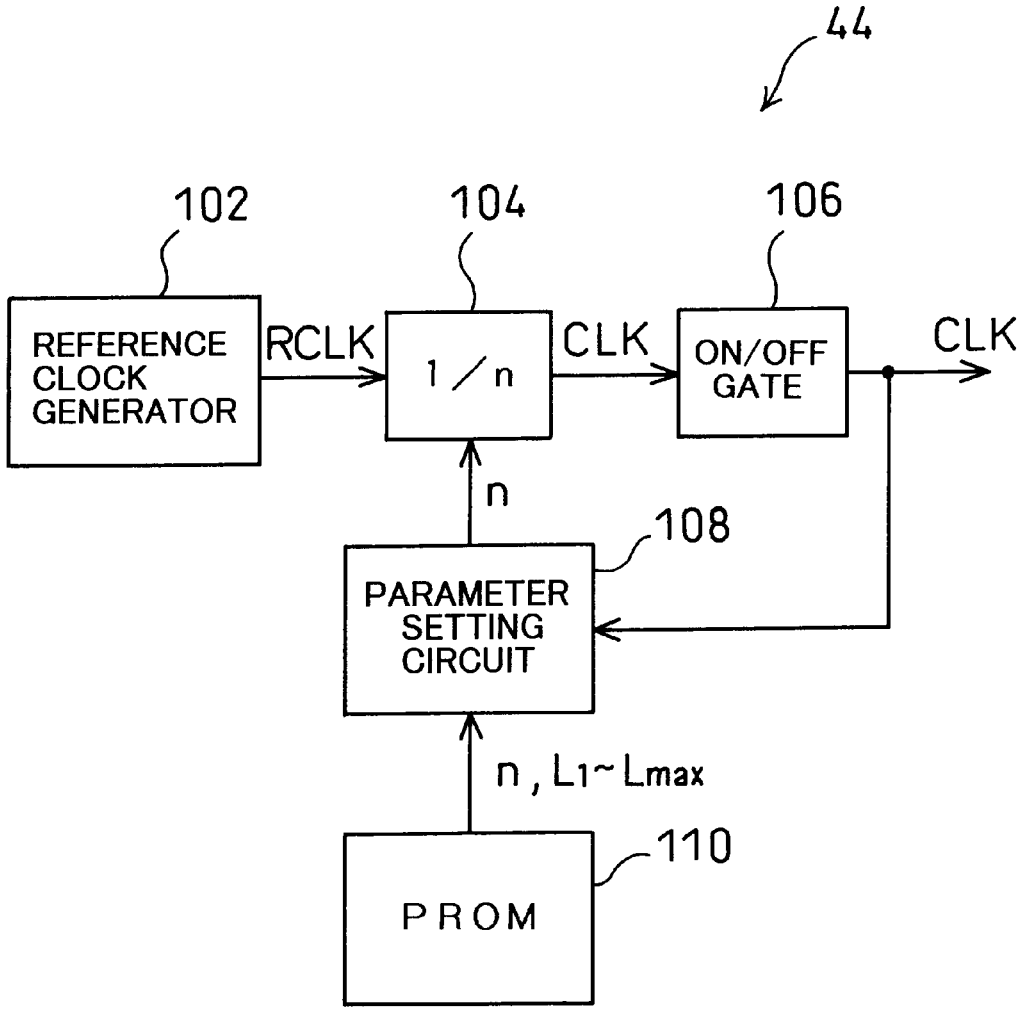
FIG. 11 is a block diagram of an internal structure of a drive clock generator.

FIG. 11 is a block diagram of the internal structure of the drive clock generator 44. The drive clock generator 44 includes a reference clock generator 102, frequency divider 104, on/off gate 106, parameter setting circuit 108 and a programmable ROM (PROM) 110. The reference clock generator 102 generates a reference clock signal RCLK having a relatively high prescribed frequency. The reference clock signal RCLK is subjected to a 1/n division by the frequency divider 104 to form the drive clock signal CLK. In accordance with a control signal from another circuit in the control circuit 40, the on/off gate 106 functions to stop and restart drive clock signals CLK going to the print head 28.

The frequency division ratios n(R1) to n(R5) of regions R1 to R5 are stored in the PROM 110, together with the positions of the boundaries L1 to Lmax between regions (or the width of each region). The frequency changes shown in FIG. 10(*e*) are achieved by adjusting the frequency division ratio n setting of the frequency divider 104. The parameter setting circuit 108 has a counter, not shown, for counting drive clock signal CLK pulses output from the on/off gate 106, and uses a comparison between the count value and the region boundary positions L1 to Lmax (or a comparison between the count value and the width of each region) to determine in which of the regions R1 to R5 the main scanning position of the carriage 31 is currently located. The starting position of the carriage 31 is determined beforehand based on a signal supplied to the control circuit 40 by the position sensor 39 (FIG. 7). The parameter setting circuit 108 reads out, from the PROM 110, the frequency division ratio n of the region in which the main scanning position of the carriage 31 is located and sets it in the frequency divider 104.

The PROM 110 corresponds to the deviation adjustment value memory 202 of FIG. 1. That is, each of the parameters {n(L1)–n(Lmax), L1–Lmax} for the multiple combinations of printing paper width and thickness are stored in the PROM 110 as printing deviation adjustment values. The other circuit elements of FIG. 11, that is, elements 102, 104, 106 and 108, together correspond to the deviation adjuster 204 of FIG. 1.

The merit of the drive clock generator 44 being thus configured is that it enables a drive clock signal CLK having a suitable frequency for each region to be readily obtained simply by adjusting the ratio n by which the reference clock signal RCLK frequency is divided, for each region. The method used in this embodiment to correct the printing position by adjusting the frequency of the drive clock signal CLK also has the merit that, compared to the conventional method in which the printing position itself is corrected, the circuit configuration is simpler, facilitating the implementation of the method.

Some printers are provided with a linear encoder to correct printing deviation caused by carriage vibration. It is difficult to use a linear encoder to correct printing deviation caused by warping of the platen. However, printing deviation caused by platen warpage can be corrected by adjusting the frequency of the print head 28 drive clock signal CLK along the main scanning direction, as described in the foregoing. That is, the present invention can be effectively applied to those types of printers that are equipped with linear encoders for correcting printing deviation. The present invention can also be effectively applied to printers that are not equipped with linear encoders for correcting printing deviation, since it makes it possible simultaneously to correct printing deviation arising from carriage vibration and printing deviation arising from platen warpage.

Figure 12:
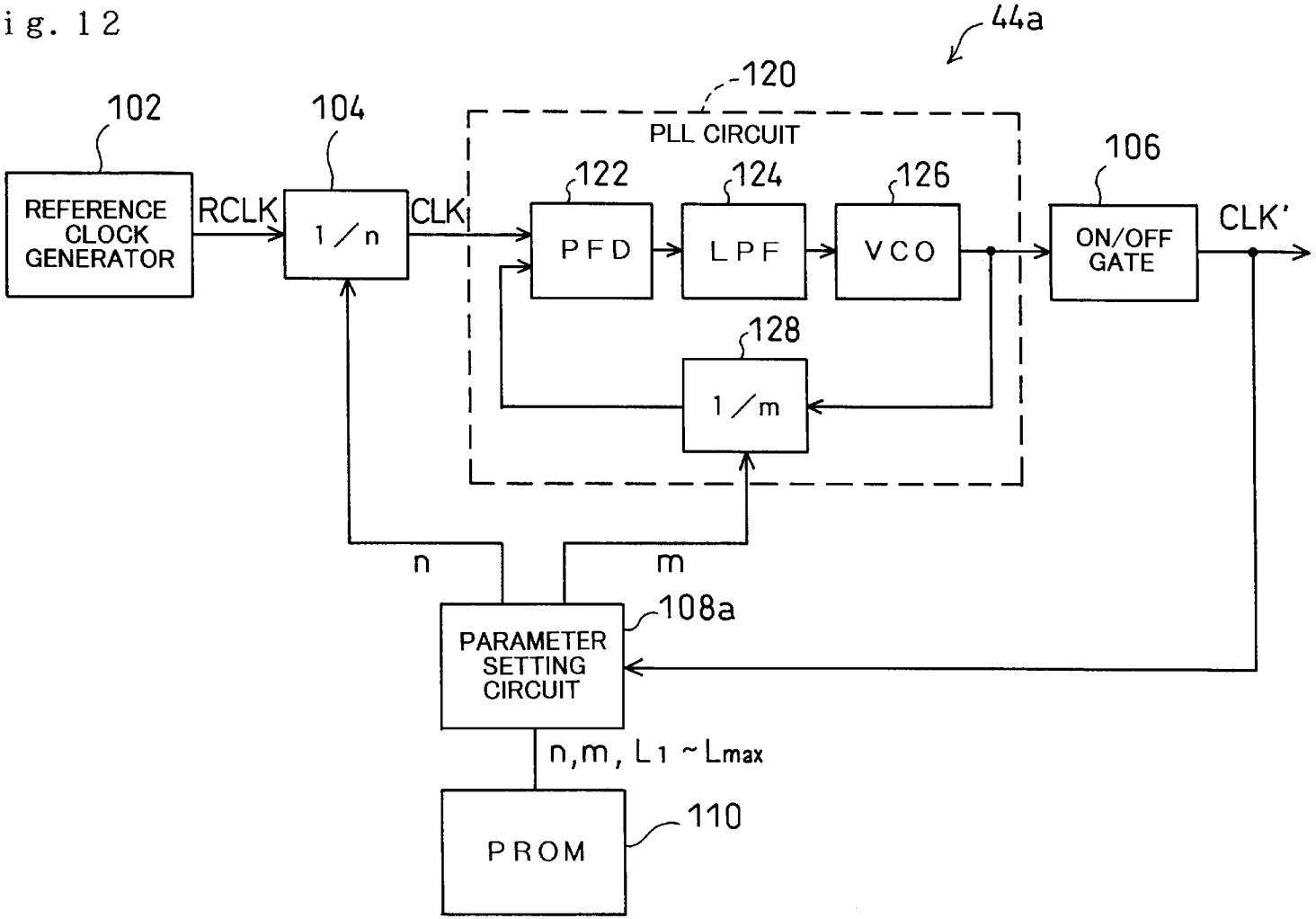
FIG. 12 is a block diagram of another internal structure of a drive clock generator.

FIG. 12 is a block diagram showing another configuration of a drive clock generator 44. This drive clock generator 44*a* has a PLL circuit 120 between the frequency divider 104 and the on/off gate 106. The addition of the PLL circuit 120 also results in some changes to the functions of the parameter setting circuit 108*a* and the contents of the PROM 110.

The PLL circuit 120 includes a phase frequency divider (PFD) 122, a low-pass filter (LPF) 124, a voltage control oscillator (VCO) 126 and a frequency divider 128. In the PLL circuit 120, a drive clock signal CLK' is generated by multiplying the frequency of the drive clock signal CLK that has been frequency-divided by a first frequency divider 104 by a factor m (which is equal to the frequency division ratio of the frequency divider 128), and this drive clock signal CLK' is supplied to the print head 28. The frequency $f_{CLK}'$ of this drive clock signal CLK' is m/n times the frequency $f_{RCLK}$ of the reference clock signal RCLK.

The parameter setting circuit 108*a* can set a suitable frequency $f_{CLK}'$ of the drive clock signal CLK' for each of the regions R1 to R5 by setting the frequency division ratioes n, m of the frequency dividers 104 and 128 to suitable values for each of the regions R1 to R5. In the circuit shown in FIG. 12, there are two parameters for frequency adjustment (n and m), allowing the frequency to be set in finer units than the circuit of FIG. 11.

The frequency divider 104 of FIG. 11 and the frequency divider 104 and PLL circuit 120 of FIG. 12 constitute a frequency converter (also called a "frequency setting unit") that generates drive clock signals by converting the frequency of the reference clock signal RCLK. However, it is to be understood that these are just configuration examples, and other configurations may be adopted for the frequency converter (frequency setting unit).

As describe above, in the case of this embodiment the printing position can be corrected so that the printing positions in the forward and reverse passes coincide almost perfectly by adjusting the frequency of the drive clock signal applied to the print head. As such, it has the merit that, compared to an arrangement in which the printing position itself is corrected, correction of printing deviation can be effected with a simpler configuration. In particular, the drive clock signal frequency can be individually set for each of the plurality of regions into which the main scanning width of the paper is divided, making it possible to achieve close to ideal correction with a simple configuration.

While in the case of the above circuit the main scanning width Lmax of the paper is divided into five equal regions R1 to R5, the regions do not have to be of equal width. Thus, the main scanning width may instead be divided into a plurality of regions of any desired width. Similarly, the number of such regions is not limited to five, but may be any number that is not less than two. However, since a higher number of regions makes it possible to achieve a correction amount that is closer to the ideal correction amount δ, it is preferable to divide the scanning width Lmax into at least five regions.

There are cases in which printing sheets have the same main scanning width Lmax but where, in practice, the main scanning range of print head 28 movement is limited to one part of the main scanning width Lmax. For example, when an image is to be printed only on the left half of the paper, the main scanning range of the print head 28 is effectively limited to the left half of the paper. In such a case, the value of the printing deviation amount Δx at position L2 of FIG. 10(*a*), for example, may differ from the amount of printing deviation that occurs when the print head 28 traverses the whole of the main scanning width Lmax of the paper. This is because printing deviation is affected by the elongation of the carriage belt. The elongation of the carriage belt depends on the acceleration of the carriage. When the print head carriage traverses the whole of the main scanning width Lmax of the paper, at point L2 the carriage is moving at a more or less uniform speed. In contrast, when the print head traverses only the left half of the paper, at point L2 the carriage is either accelerating or decelerating. As a result, at the same point L2, the printing deviation Δx will differ depending on what the actual main scanning range of the print head 28 is. In view of this fact, even when the paper used has the same main scanning width Lmax, it is preferable to set a different printing deviation adjustment value (correction amount) for each of a plurality of positions on the paper, based on the actual scanning range of the print head 28.

The foregoing description has been made with reference to main scanning effected by moving the print head. Instead, however, main scanning can be effected by moving the paper. That is to say, the present invention can be applied to any printer in which bidirectional printing is achieved by relative movement between at least the printing medium and the print head.

Part of the configuration implemented in hardware in the above-described embodiments of the present invention may instead be implemented in software. Conversely, also, part of the configuration implemented in software may instead be implemented in hardware. For example, the functions of part of the circuitry shown in FIG. 11 and FIG. 12 (the parameter setting circuits 108 and 108*a*, for example) may instead be effected by a microprocessor executing a computer program stored on a storage medium. Also, part or all of the functions of the control circuit 40 may be executed by a microprocessor (CPU) in the computer 20.

Storage media that can be used include flexible disks, CD-ROM, optical disks, IC cards, ROM cartridges, punched cards, printed materials on which bar codes or other such symbols are printed, the internal memory (RAM and ROM), external storage devices of a computer and other media that can be read by a computer.

The present invention can be applied to a printer that prints bidirectionally such as a bidirectional type ink-jet printer.

What is claimed is:

1. A printer that is able to bi-directionally print images on a printing medium during reciprocal main scanning in each direction, the printer comprising:

a print head;

a drive mechanism that effects relative movement between at least the print head and the printing medium in a main scanning direction and a sub-scanning direction and drives the print head to print on the printing medium; and a controller that controls the drive mechanism, the controller including, an adjustment value memory for storing a plurality of adjustment values associated with a plurality of printing media having different widths in the main scanning direction; and a printing deviation adjuster which selects one or more working adjustment values from said plurality of adjustment values according to a width of the printing medium actually used for printing, and adjusts printing positions in the main scanning direction on at least one of forward and reverse passes using the one or more working adjustment values so as to reduce printing deviation on at least one of the forward pass and the reverse pass.

2. A printer that is able to bi-directionally print images on a printing medium during reciprocal main scanning in each direction, the printer comprising:

a print head;

a drive mechanism that effects relative movement between at least the print head and the printing medium in a main scanning direction and a sub-scanning direction and drives the print head to print on the printing medium; and a controller that controls the drive mechanism, including, a variable frequency drive clock generator that generates a drive clock signal that can be set to a plurality of frequency settings along the main scanning direction and that applies the drive clock signal to the print head during at least one of a forward pass and a reverse pass so as to reduce printing deviation on at least one of the forward pass and the reverse pass.

3. A method of adjusting printing position in a main scanning direction for a printer that is able to bi-directionally print images on a printing medium with a print head during reciprocal main scanning in each direction, the method comprising the steps of:

providing a plurality of adjustment values associated with a plurality of printing media having a plurality of widths in the main scanning direction;

selecting a working adjustment value from the plurality of adjustment values according to the width of the printing medium actually used for printing; and adjusting printing positions in the main scanning direction on at least one of forward and reverse passes with the working adjustment value so as to reduce printing deviation on the forward and reverse passes.

4. A method of adjusting printing position in a main scanning direction for a printer that is able to bi-directionally print images on a printing medium with a print head during reciprocal main scanning in each direction, the method comprising the steps of:

generating a drive clock signal that is applied to the print head; and setting a frequency of the drive clock signal at plural values on a main scan range directed along the main scanning direction during at least one of a forward pass and a reverse pass so as to reduce printing deviation on at least one of a forward pass and a reverse pass.

5. The printer according to claim 1, further comprising:

a memory which stores data for printing a plurality of printing deviation check patterns for the plurality of printing media.

6. The printer according to claim 1, wherein the printing deviation adjuster is configured to correct the printing deviation adjustment value using an offset based on a thickness of the printing media actually used for printing.

7. The printer according to claim 1, wherein the printing deviation adjuster is configured to adjust the printing position at a center position in the main scanning direction of each of the plurality of printing media.

8. A printer according to claim 1, wherein the printing deviation adjuster is configured to adjust the printing position at each of a plurality of positions along the main scanning direction.

9. A printer according to claim 2, wherein the drive clock generator individually sets the drive clock signal frequency for each of a plurality of regions into which a main scanning range is divided.

10. A printer according to claim 9, wherein the drive clock generator further comprises:

an adjustment memory which stores parameters used to set the drive clock signal frequency for each of the plurality of regions; and a reference clock generator that generates a reference clock signal having a prescribed base frequency;

a frequency converter that, using the parameters read out of the adjustment memory, generates the drive clock signal by converting the frequency of the reference clock signal; and a parameter setting unit that determines in which of the plurality of regions at which a main scanning position of the print head is located, reads out from the adjustment memory the parameters for the region in which the main scanning position is located, and sets the parameters in the frequency converter.

11. A printer according to claim 10, wherein the parameter setting unit changes a section of the plurality of regions and the parameters in accordance with the width and thickness in the main scanning direction of the printing medium that is used.

12. The method according to claim 3, further comprising:

preparing adjustment values for the plurality of printing media based on a printing deviation on a plurality of deviation check patterns each printed on a corresponding one of the plurality of printing media.

13. The method according to claim 3, further comprising:

preparing adjustment values for the plurality from printing deviation on a plurality of printing deviation check patterns all of which are printed on a selected one of the plurality of printing media.

14. The method according to claim 3, further comprising:

correcting the working adjustment value using an offset based on a thickness of the printing media actually used for printing.

15. The method according to claim 3, wherein the step of adjusting printing positions is carried out at a center position in the main scanning direction of each of the plurality of printing media.

16. A method according to claim 3, wherein the step of adjusting printing positions is carried out at each of a plurality of points in the main scanning direction of each of the plurality of printing media.

17. A method according to claim 4, further comprising:

setting the frequency of the drive clock signal individually in each of a plurality of regions into which a main scanning range is divided.

18. A method according to claim 17, wherein the step of setting the frequency of the drive clock signal further comprises:

preparing in advance parameters used to set the drive clock signal frequency for each of the plurality of regions;

generating a reference clock signal having a prescribed base frequency;

determining in which of the plurality of regions a main scanning position of the print head is located; and generating the drive clock signal by converting the base frequency of the reference clock signal using the parameters for the region in which the main scanning position of the print head is located.

19. A method according to claim 18, wherein a section of the plurality of regions and the parameter values are changed in accordance with the width and thickness in the main scanning direction of the printing media that is used.

20. A printer that is able to bidirectionally print images on a printing medium during reciprocal main scanning in each direction, the printer comprising:

a print head;

a drive mechanism that effects relative movement between at least the print head and the printing medium in a main scanning direction and a sub-scanning direction and drives the print head to print on the printing medium; and a controller that controls the drive mechanism, the controller including a printing deviation adjuster that adjusts printing positions in the main scanning direction on at least one of a forward pass and a reverse pass so that the printing positions in the main scanning direction on the forward and reverse passes are made to substantially coincide, wherein the printing deviation adjuster applies a plurality of adjustment values at a plurality of positions of the print head in the main scanning direction.

* * * * *